US012716040B2

(12) United States Patent
Stark et al.

(10) Patent No.: US 12,716,040 B2
(45) Date of Patent: Aug. 25, 2026

(54) FUEL COMPOSITIONS COMPRISING A FUEL OIL OBTAINED FROM THE DISTILLATION OF A PYROLYSIS OIL

(71) Applicant: Innospec Fuel Specialties LLC, Englewood, CO (US)

(72) Inventors: Joseph L. Stark, Katy, TX (US); Paul J. Biggerstaff, Sugar Land, TX (US)

(73) Assignee: Innospec Fuel Specialties LLC, Englewood, CO (US)

( * ) Notice: Subject to any disclaimer, the term of this patent is extended or adjusted under 35 U.S.C. 154(b) by 6 days.

(21) Appl. No.: 18/389,434

(22) Filed: Nov. 14, 2023

(65) Prior Publication Data

US 2024/0174933 A1 May 30, 2024

Related U.S. Application Data

(60) Provisional application No. 63/425,420, filed on Nov. 15, 2022.

(51) Int. Cl.

| | |
|---|---|
| ***C10L 1/22*** | (2006.01) |
| ***C10G 7/00*** | (2006.01) |
| ***C10L 10/14*** | (2006.01) |

(52) U.S. Cl.

CPC ..... *C10L 1/22* (2013.01); *C10G 7/006* (2013.01); *C10L 10/14* (2013.01); *C10L 2200/0438* (2013.01); *C10L 2230/081* (2013.01); *C10L 2230/14* (2013.01); *C10L 2290/02* (2013.01)

(58) Field of Classification Search

CPC .... C10L 1/22; C10L 10/14; C10L 2200/0438; C10L 2230/081; C10L 2230/14; C10L 2290/02; C10L 1/1832; C10L 1/1835; C10L 1/223; C10L 1/2383; C10L 1/1881; C10L 2200/0423; C10L 1/10; C10L 1/1683; C10L 1/234; C10L 1/2364; C10L 1/238; C10L 1/2381; C10L 10/00; C10L 10/18; C10G 7/006; C10G 1/10; C08J 11/12; C10B 53/07

See application file for complete search history.

(56) References Cited

U.S. PATENT DOCUMENTS

| | | | | |
|---|---|---|---|---|
| 4,797,134 | A | 1/1989 | Vataru | |
| 5,039,437 | A | 8/1991 | Martella | |
| 5,588,973 | A | 12/1996 | Blackborow | |
| 5,925,151 | A | 7/1999 | DeCanio et al. | |
| 6,838,422 | B2 | 1/2005 | Man et al. | |
| 7,291,758 | B2 | 11/2007 | Bohnenpoll et al. | |
| 7,563,291 | B2 | 7/2009 | Siggelkow et al. | |
| 9,321,976 | B1 | 4/2016 | Fang et al. | |
| 11,130,923 | B2 | 9/2021 | Hansch et al. | |
| 2006/0219979 | A1 | 10/2006 | Degussa | |
| 2007/0221539 | A1 | 9/2007 | Cohrs et al. | |
| 2009/0253948 | A1 | 10/2009 | McCall et al. | |
| 2015/0033617 | A1 | 2/2015 | Arondel et al. | |
| 2016/0068776 | A1 | 3/2016 | Papin et al. | |
| 2022/0289648 | A1* | 9/2022 | Arnst | C07C 4/04 |
| 2023/0085274 | A1* | 3/2023 | Liu | C10G 1/002 585/240 |
| 2023/0120367 | A1* | 4/2023 | Vyakaranam | C10G 75/04 208/48 AA |
| 2024/0271053 | A1* | 8/2024 | Stark | C10L 1/1981 |
| 2025/0206952 | A1* | 6/2025 | Dale | C08L 91/00 |

FOREIGN PATENT DOCUMENTS

| | | | | |
|---|---|---|---|---|
| CN | 102453556 | A | 5/2012 | |
| CN | 103923710 | A | 7/2014 | |
| CN | 108251170 | A | 7/2018 | |
| CN | 109504472 | A | 3/2019 | |
| CN | 110041975 | A | 7/2019 | |
| CN | 106554828 | B | 3/2021 | |
| CN | 114058416 | A | 2/2022 | |
| EP | 0565285 | A1 | 10/1993 | |
| EP | 0831141 | A1 | 3/1998 | |
| EP | 1344785 | A1 | 9/2003 | |
| JP | 2007153936 | A | 6/2007 | |
| JP | 2008214368 | A | 9/2008 | |
| JP | 2008214369 | A | 9/2008 | |
| JP | 2010100779 | A | 5/2010 | |
| WO | 02068570 | A2 | 9/2002 | |
| WO | 2007015080 | A1 | 2/2007 | |
| WO | WO-2018188982 | A1 * | 10/2018 | C10L 1/2222 |
| WO | 2021126342 | A1 | 6/2021 | |

(Continued)

OTHER PUBLICATIONS

Balaji et al., "Ecological influence of addition of antioxidant and incorporation of selective catalytic reduction on NO emission in off-road engines powered by waste plastic oil blend", Environmental Progress & Sustainable Energy, John Wiley & Sons, Inc., US, vol. 39, No. 4, dated Dec. 13, 2019 (12 pages).

(Continued)

*Primary Examiner* — Ellen M Mcavoy

(74) *Attorney, Agent, or Firm* — Jason A. Smith; Shumaker, Loop & Kendrick, LLP

(57) ABSTRACT

A fuel composition including a fuel oil obtained from the distillation of a pyrolysis oil having a boiling point distribution within the gasoline range and, as an additive, one or more of: (a) an antioxidant; and (b) a stabilising additive selected from (x) alkoxylated amine compounds; (y) aldehyde-alkylphenol copolymers; (z) acylated nitrogen compounds; and mixtures thereof. Also disclosed are a method and use for improving the stability of a fuel composition including a fuel oil obtained from the distillation of a pyrolysis oil, having a boiling point distribution within the gasoline range, which involve adding to the composition one or more additives selected from (a) and (b).

15 Claims, No Drawings

(56) References Cited

FOREIGN PATENT DOCUMENTS

| | | | | |
|---|---|---|---|---|
| WO | WO-2022192577 A1 * | 9/2022 | ..... | C07C 4/04 |
| WO | WO-2023180749 A1 * | 9/2023 | ..... | C08L 61/04 |
| WO | WO-2023183460 A1 * | 9/2023 | ..... | C10G 1/10 |

OTHER PUBLICATIONS

International Search Report and Written Opinion (ISR) issued for PCT/GB2023/052986, mailed Feb. 2, 2024 (13 pages).
GB Search Report issued for GB Application No. GB2300312.2 mailed Jun. 15, 2023 (7 pages).
International Search Report (ISR) for PCT/GB2023/052985 mailed Feb. 2, 2024 (4 pages).
Written Opinion (WO) for PCT/GB2023/052985 mailed Feb. 2, 2024 (4 pages).
Search and Examination Report for GB 2317451.9 mailed May 24, 2024 (5 pages).
Non-Final Office Action issued for U.S. Appl. No. 18/389,414, mailed Aug. 29, 2024 (7 pages).
Non-Final Office Action issued for US Pat. U.S. Appl. No. 18/389,414, mailed Mar. 6, 2025 (9 pages).
Office Action for U.S. Appl. No. 18/389,414 dated Aug. 18, 2025.
Non-Final Office Action dated Apr. 7, 2026 issued in U.S. Appl. No. 18/389,414 (14 pages).

* cited by examiner

FUEL COMPOSITIONS COMPRISING A FUEL OIL OBTAINED FROM THE DISTILLATION OF A PYROLYSIS OIL

TECHNICAL FIELD AND BACKGROUND

The present invention relates to fuel compositions derived from plastic pyrolysis oils and to methods and uses relating thereto. In particular the invention relates to additives for improving the stability of fuel compositions derived from plastic pyrolysis oils.

Pyrolysis oils are the fluids generated directly from the pyrolysis of waste, for example plastic waste, biomass for example agricultural waste, forestry waste, waste cooking oils, algae waste, used tyres or waste rubber. Examples of waste plastic which may be pyrolysed to produce plastic pyrolysis oils include low density polyethylene, high density polyethylene, ultra high density polyethylene, polypropylene, polystyrene, polyethylene terephthalates (PET), rubber (e.g. from tyres), polyacrylate and polynitrile.

The treatment of waste plastic to provide a pyrolysis oil typically involves first grinding the plastic and then optionally melting it, for example at about 200° C. The molten plastic may be optionally further processed, for example by passing through a heated screw heater before heating in the absence of oxygen at temperatures of 400 to 600° C. which leads to thermal decomposition of the plastic. The mixture obtained may then be contacted with a suitable catalyst. The mixture is then condensed to produce a crude plastic pyrolysis oil, which may be otherwise known as synthetic crude oil. The crude plastic pyrolysis oil can either be sold in crude form or be treated at a refinery to provide finished fuels. At the refinery the pyrolysis oil may be optionally washed to remove char and to reduce its metal content. The various processing steps and the temperatures used depends on the nature of the plastic feedstock.

Refining the optionally washed crude plastic pyrolysis oil involves heating the oil in a distillation column and collecting the desired fractions. This may be done on-site where the crude plastic pyrolysis oil is produced or may be carried out in a separate refinery. Gasoline fuel fractions typically make up around half of the distillation products obtained from crude plastic pyrolysis oils.

Although the fuels obtained from the distillation of crude pyrolysis oils have the same boiling point ranges as gasoline fuels obtained from mineral sources, the chemical composition of the distillate fuel oil obtained is quite different.

Fuels obtained from the fractional distillation of crude oil typically contain high levels sulfur and aromatic compounds. These fuels usually need to be hydrotreated before use.

Fuels obtained from the fractional distillation of plastic pyrolysis oils typically have a much lower proportion of sulfur containing compounds than those obtained from the fractional distillation of crude oil. This means that hydrotreatment is not always necessary and straight run distillate fractions can be used directly in internal combustion engines, such as direct injection engines and spark ignition engines. However because the chemical composition of fuels obtained from plastic pyrolysis oils is quite different to that of mineral derived fuels, the stability of these fuels is different.

Additives are often added to fuel to reduce or prevent sedimentation and/or oxidation during storage. Different fuels degrade in different ways, for example by thermal, oxidative, polymerisation or condensation pathways. Sediments or precipitates which may form on storage or at low temperatures in fuels derived from pyrolysis oils are different to those which form in mineral fuels. A further major difference is that the olefin content of fuels obtained from pyrolysis oils may be significantly higher than in fuels obtained from mineral oil. Fuels obtained from mineral oil usually contain up to 5 wt % olefins, with butylene and propylene being the main olefin components. This means that additives which are used, for example, to provide stability in mineral distillate fuels are not necessarily effective in fuels obtained from the distillation of pyrolysis oils. To enable such fuels to be fully utilised there is a need to provide stabilising additives to ensure they meet the required standards, especially ASTM D4814 and EN228.

SUMMARY

The present inventors have found that certain compounds are effective at reducing sedimentation from and/or improving the stability of fuel compositions obtained from the distillation of pyrolysis oils.

DETAILED DESCRIPTION

According to a first aspect of the present invention there is provided a fuel composition comprising a fuel oil obtained from the distillation of a pyrolysis oil having a boiling point distribution within the gasoline range and, as an additive, one or more of:

(a) an antioxidant; and (b) a stabilising additive selected from (x) alkoxylated amine compounds; (y) aldehyde-alkylphenol copolymers; (z) acylated nitrogen compounds; and mixtures thereof.

The first aspect of the present invention relates to a fuel composition comprising a fuel obtained from the distillation of a pyrolysis oil having a boiling point distribution within the gasoline range.

The pyrolysis oil may be obtained from the pyrolysis of any type of waste. The components of the pyrolysis oil and the properties thereof and the distillate fraction obtained therefrom will depend on the types of waste that was pyrolysed and the pyrolysis conditions. For example the pyrolysis oil may be obtained from the pyrolysis of plastic waste, agricultural waste, forestry waste, waste cooking oils, algae waste, used tyres and rubber waste.

Preferably the pyrolysis oil comprises a plastic pyrolysis oil. The plastic pyrolysis oil may be obtained from the pyrolysis of any type of plastic.

Preferred plastic pyrolysis oils are obtained from the pyrolysis of one or polymers selected from low density polyethylene, high density polyethylene, ultra high density polyethylene, polypropylene, PET, polyacrylate, polynitrile and mixtures thereof.

The fuel composition of the present invention comprises a fuel oil obtained from the distillation of a pyrolysis oil, preferably a plastic pyrolysis oil. Suitably the distillate fuel oil boils in the range 30 to 225° C., preferably 35 to 200° C.

The fuel oil obtained from the distillation of a pyrolysis oil having a boiling point distribution within the gasoline range (otherwise known as naphtha) may be referred to herein as the pyrolysis oil gasoline distillate.

The fuel composition of the present invention is suitable for use as gasoline fuel oil. Preferably the fuel composition complies with ASTM D4814 and EN228.

The pyrolysis oil gasoline distillate may optionally be hydrotreated and/or treated using a cracking process. However, due to the typically low aromatic and sulfur content of fuel oils obtained from pyrolysis oils it is possible to use straight run distillates.

In some embodiments the fuel composition of the first aspect comprises a straight run distillate fraction oil having a boiling point distribution within the gasoline range directly obtained from the distillation of a pyrolysis oil without further treatment.

The fuel composition of the present invention may be considered to comprise a fuel component and additive components (a) and/or (b), wherein the fuel component comprises the pyrolysis oil gasoline distillate. In some embodiments, the fuel component of the fuel composition consists essentially of the pyrolysis oil gasoline distillate. Therefore the fuel composition may consist or consist essentially of the pyrolysis oil gasoline distillate and additive components (a) and/or (b).

In some embodiments, the fuel component of the fuel composition may be a blended fuel component comprising the pyrolysis oil gasoline distillate, preferably a plastic pyrolysis oil gasoline distillate, and one or more further fuel components, for example one or more further fuel oil components having a boiling point range within the gasoline range obtained from mineral and/or renewable sources. Fuel components obtained from other synthetic sources may also be included. Alcohols may also be present.

In such embodiments, the fuel component suitably comprises at least 1 vol % of the pyrolysis oil gasoline distillate, suitably at least 10 vol %, at least 20 vol %, at least 50 vol %, at least 80 vol % or at least 90 vol %. Suitably the fuel component comprises up to 100 vol % of the pyrolysis oil gasoline distillate, up to 99 vol %, up to 95 vol % or up to 90 vol % of the pyrolysis oil gasoline distillate. Suitably the fuel component comprises from 1 to 100 vol % of the pyrolysis oil gasoline distillate, suitably from 1 to 99 vol %, from 10 to 99 vol % or from 50 to 99 vol % of the pyrolysis oil gasoline distillate.

In such embodiments, the fuel component of the fuel composition may comprise a petroleum-based fuel oil, especially a gasoline fuel oil. Such gasoline fuel oils generally boil within the range of from 30 to 225° C., e.g. 35 to 200° C. The gasoline fuel oil may comprise atmospheric distillate or vacuum distillate, cracked gas oil, or a blend in any proportion of straight run and refinery streams such as thermally and/or catalytically cracked and hydro-cracked distillates.

The fuel component of the fuel composition may comprise from 0 to 99 vol % of such gasoline fuel oil, from 1 to 99 vol %, from 1 to 90 vol % or from 1 to 50 vol % of gasoline fuel oil.

By the term "gasoline", it is meant a liquid fuel for use with spark ignition engines (typically or preferably containing primarily or only C4-C12 hydrocarbons) and satisfying international gasoline specifications, such as ASTM D-4814 and EN228.

In such embodiments, the fuel component of the fuel composition may comprise oxygenated components, such as alcohols or ethers. Suitable oxygenated components may be selected from methanol, ethanol, butanol, methyl t-butyl ether (MTBE), ethyl t-butyl ether (ETBE), preferably ethanol.

The fuel component may comprise from 0 to 85 vol % of such oxygenated components, from 1 to 85 vol %, from 1 to 50 vol %, from 1 to 20 vol % or from 5 to 15 vol % of such oxygenated components, suitably ethanol.

In some embodiments, the fuel component of the fuel composition of the present invention may comprise from 1 to 99 vol % of the pyrolysis oil gasoline distillate, from 1 to 99 vol % of gasoline fuel oil and from 1 to 85 vol % of oxygenated components, suitably ethanol.

In such embodiments, the fuel component suitably comprises from 1 to 20 vol % ethanol.

The fuel component of the fuel composition of the present invention may comprise from 50 to 99 vol % of the pyrolysis oil gasoline distillate, from 1 to 50 vol % of gasoline fuel oil and from 1 to 20 vol % of oxygenated components, suitably ethanol.

The fuel composition of the present invention comprises a pyrolysis oil gasoline distillate. This component of the fuel composition comprises olefins. Preferably the pyrolysis oil gasoline distillate comprises at least 10 wt % olefins, at least 20 wt % olefins, at least 30 wt % or at least 40 wt % olefins. Preferably the pyrolysis oil gasoline distillate comprises up to 70 wt % olefins, up to 65 wt % olefins or up to 60 wt % olefins. The pyrolysis oil gasoline distillate preferably comprises from 10 to 65 wt % olefins, preferably from 30 wt % to 60 wt % or 40 to 60 wt % olefins. The olefin content of the pyrolysis oil gasoline distillate is suitably measured according to the method of ASTM D1319. The olefins contained in the pyrolysis oil gasoline distillate suitably include propylene and butylene.

In preferred embodiments the fuel composition has a sulphur content of at most 0.05% by weight, more preferably of at most 0.035% by weight, especially of at most 0.015%. Fuels with even lower levels of sulphur are also suitable such as, fuels with less than 50 ppm sulphur by weight, preferably less than 20 ppm, for example 10 ppm or less.

The fuel composition of the first aspect comprises one or more of (a) an antioxidant and (b) a stabilising additive.

In some embodiments the composition of the first aspect comprises (a) an antioxidant. Mixtures of two or more antioxidants may be present.

In some embodiments the composition of the first aspect comprises (b) a stabilising additive.

In some embodiments the composition of the first aspect comprises (a) an antioxidant and (b) a stabilising additive.

The stabilising additive may comprise (x) alkoxylated amine compounds, (y) aldehyde-alkylphenol copolymers, (z) acylated nitrogen compounds, or mixtures thereof.

In some embodiments the composition of the first aspect comprises (b) a stabilising additive comprising (x) alkoxylated amine compounds.

In some embodiments the composition of the first aspect comprises (b) a stabilising additive comprising (y) aldehyde-alkylphenol copolymers.

In some embodiments the composition of the first aspect comprises (b) a stabilising additive comprising (z) acylated nitrogen compounds.

In some preferred embodiments the composition of the first aspect comprises (b) a stabilising additive comprising (x) alkoxylated amine compounds and (y) aldehyde-alkylphenol copolymers.

In some embodiments the composition of the first aspect comprises (b) a stabilising additive comprising (x) alkoxylated amine compounds and (z) acylated nitrogen compounds.

In some embodiments the composition of the first aspect comprises (b) a stabilising additive comprising (y) aldehyde-alkyl phenol copolymers and (z) acylated nitrogen compounds.

In some embodiments the composition of the first aspect comprises (b) a stabilising additive comprising (x) alkoxylated amine compounds, (y) aldehyde-alkylphenol copolymers and (z) acylated nitrogen compounds.

In some embodiments the composition of the first aspect comprises (a) an antioxidant and (b) a stabilising additive comprising (x) alkoxylated amine compounds.

In some embodiments the composition of the first aspect comprises (a) an antioxidant and (b) a stabilising additive comprising (y) aldehyde-alkylphenol copolymers.

In some embodiments the composition of the first aspect comprises (a) an antioxidant and (b) a stabilising additive comprising (z) acylated nitrogen compounds.

In some preferred embodiments the composition of the first aspect comprises (a) an antioxidant and (b) a stabilising additive comprising (x) alkoxylated amine compounds and (y) aldehyde-alkylphenol copolymers.

In some preferred embodiments the composition of the first aspect comprises (a) an antioxidant and (b) a stabilising additive comprising (x) alkoxylated amine compounds and (z) acylated nitrogen compounds.

In some embodiments the composition of the first aspect comprises (a) an antioxidant and (b) a stabilising additive comprising (y) aldehyde-alkylphenol copolymers and (z) acylated nitrogen compounds.

In some preferred embodiments the composition of the first aspect comprises (a) an antioxidant and (b) a stabilising additive comprising (x) alkoxylated amine compounds (y) aldehyde-alkylphenol copolymers and (z) acylated nitrogen compounds.

Suitable antioxidants for use herein include phenolic antioxidants and nitrogen containing antioxidants.

In some preferred embodiments the fuel composition of the first aspect comprises a phenolic antioxidant.

In some embodiments the fuel composition of the first aspect comprises a nitrogen containing antioxidant and a phenolic antioxidant.

Any suitable phenolic antioxidant may be used. Suitable antioxidants will be known to the person skilled in the art.

By phenolic antioxidant compound we mean to include any compound which contains a phenol moiety i.e., a benzene ring which is substituted with a hydroxyl group. This may be a very simple compound, for example a benzene diol, an alkyl substituted phenol or a benzene triol.

Alternatively the phenolic antioxidant may be part of a more complex molecule. It may include two phenol moieties, for example, see the compounds disclosed in US 2006/0219979.

Suitable phenolic antioxidant compounds for use in the present invention include those of formula (I):

(I)

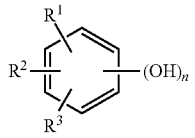

wherein $R^1$ is selected from an optionally substituted alkyl or alkenyl group, an aryl group, an aralkyl group; an ester, a carboxylic acid, an aldehyde, a ketone, an ether, an alcohol, an amine or an amide; $R^2$ and $R^3$ are independently selected from hydrogen, an optionally substituted alkyl or alkenyl group, an aryl group, an ester group, a ketone, an aldehyde, a carboxylic acid, an ether, an alcohol, an amine or an amide; and n is an integer from 1 to 5.

Preferably $R^1$ is an alkyl group, preferably having 1 to 9 carbon atoms, and may be straight chained or branched. Preferably $R^1$ is selected from methyl, ethyl, isopropyl, and tertiary butyl. $R^1$ and $R^2$ may together form a cyclic substituent, either alkyl or aryl. $R^2$ and $R^3$ are preferably hydrogen or an alkyl group having 1 to 9 carbon atoms. Preferably $R^2$ and $R^3$ are independently selected from hydrogen, methyl, ethyl, tertiary butyl and isopropyl. Preferably n is 1, 2 or 3.

Preferred phenolic antioxidant compounds for use in the present invention are substituted benzene compounds having 1 or more hydroxy substituents. Examples include tertiarybutylhydroquinone (TBHQ or MTBHQ), 2,5-di-tertiarybutylhydroquinone (DTBHQ), pyrogallol, pyrocatechol 2,6-di-tert-butyl-4-methylphenol (BHT), 2,6-ditertiary-butyl-phenol, propylgallate and tertiarybutylcatechol.

One especially preferred phenolic antioxidant for use herein is 2,6-ditertiary-butyl-phenol. However as the skilled person will appreciate commercial sources of this compound often comprise mixtures including tertiary and tritertiary-butyl-phenols.

Suitable nitrogen containing antioxidants include aromatic amines, hindered amines, N-oxides, polyalkylene polyamines, phenylene diamines, substituted hydroxylamines and mixtures thereof.

Suitable aromatic amines include diaminobenzene and alkylated diamino benzenes, especially dialkylated and trialkylated diaminobenzenes, for example p-phenylenediamine, 3,5-diethyltoluene-2,4-diamine; 3,5-diethyltoluene-2,2-diamine; 2,4,6-triethylbenzene-2,6-diamine alkylated diphenyl amines; diphenylamines and alkylated diphenylamines, for example N,N-diphenyl-1,4-phenylenediamines; and naphthylamines, for example N-phenyl-1-napthylamine and N-phenyl-2-naphthylamine.

Suitable hindered amines include secondary and tertiary aliphatic amines, for example dimethyl cyclohexylamine and diethylhydroxylamine.

Suitable N-oxides include (2,2,6,6-Tetramethylpiperidin-1-yl)oxyl (TEMPO) and derivatives thereof.

Preferably the one or more nitrogen containing antioxidants (a) are selected from:

(i) phenylenediamines;

(ii) substituted hydroxylamines; and (iii) mixtures thereof.

Some preferred phenylenediamine antioxidants (i) suitable for use in the present invention include those of formula:

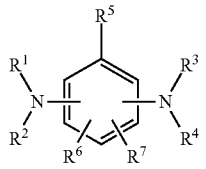

wherein $R^1$, $R^2$, $R^3$, $R^4$, $R^5$, $R^6$ and $R^7$ are independently selected from hydrogen, an optionally substituted alkyl, alkenyl, aryl, alkaryl or aralkyl group, an ester, a carboxylic acid, an aldehyde, a ketone, an ether, an alcohol, an amine or an amide. Preferably $R^1$ is hydrogen. Preferably $R^3$ is hydrogen. Preferably $R^2$ is an alkyl group, preferably having 1-10 carbon atoms. More preferably $R^2$ is an alkyl group having 1-5 carbon atoms. Preferably $R^2$ is selected from methyl, ethyl, propyl, isopropyl, butyl, isobutyl, secbutyl and tertiarybutyl. Most preferably $R^2$ is isopropyl or secbutyl. Preferably $R^4$ is an alkyl group, preferably having 1-10 carbon atoms. More preferably $R^4$ is an alkyl group having 1-5 carbon atoms. $R^4$ is preferably selected from methyl, ethyl, propyl, isopropyl, secbutyl, butyl, tertiarybutyl and isobutyl. Most preferably $R^4$ is isopropyl or sec butyl.

$R^5$, $R^6$ and $R^7$ are preferably selected from hydrogen or alkyl groups, more preferably from hydrogen and alkyl groups having 1-10 carbon atoms, more preferably from hydrogen and alkyl groups having 1-5 carbon atoms. Preferably $R^5$, $R^6$ and $R^7$ are independently selected from hydrogen, methyl, ethyl, propyl, isopropyl, butyl, tertiarybutyl and isobutyl. Most preferably $R^5$ is hydrogen. Most preferably $R^6$ is hydrogen. Most preferably $R^7$ is hydrogen.

In especially preferred embodiments each of $R^1$, $R^2$, $R^3$, $R^4$, $R^5$, $R^6$ and $R^7$ is hydrogen and component (i) comprises p-phenylene diamine.

Component (i) may comprise a mixture of compounds and/or a mixture of isomers.

Preferred substituted hydroxylamine compounds (ii) for use herein are compounds of formula $R_2NOH$ in which each R is independently hydrogen or an optionally substituted hydrocarbyl group. Preferably each R is an optionally substituted hydrocarbyl group. Each R may be the same or different. Preferably each R is the same.

Preferably each R is an optionally substituted alkyl or alkenyl group, preferably having from 1 to 12 carbon atoms, suitably 1 to 10 or 1 to 8 carbon atoms, for example 1 to 6, preferably from 1 to 4 carbon atoms. Preferably each R is an alkyl group. Each R may be a substituted alkyl group, for example a hydroxy substituted alkyl group. Preferably each R is an unsubstituted alkyl group or a hydroxy alkyl group. More preferably each R is an unsubstituted alkyl group. The alkyl chain may be straight-chained or branched. Preferably each R is selected from methyl, ethyl, propyl and butyl, including isomers thereof. Most preferably each R is ethyl.

Preferably component (ii) comprises diethylhydroxylamine.

Component (ii) may comprise a mixture of compounds and/or a mixture of isomers.

In some embodiments the fuel composition of the first aspect includes (i) phenylenediamines.

In some embodiments the fuel composition of the first aspect includes (ii) substituted hydroxylamines.

In some embodiments the fuel composition of the first aspect includes (i) phenylenediamines and (ii) substituted hydroxylamines.

The fuel composition of the first aspect may comprise (b) a stabilising additive selected from (x) alkoxylated amine compounds, (y) aldehyde-alkylphenol copolymers, (z) acylated nitrogen compounds or mixtures thereof.

By stabilising additive we mean to refer to a component which improves the stability of the fuel composition, for example the storage or oxidation stability thereof, or which aids the dispersion of solids, waxes or high molecular weight gums within the fuel composition. Suitable stabilising additives may be known in the art as dispersants.

In some embodiments the composition of the first aspect may comprise (x) alkoxylated amine compounds.

The fuel composition may include any alkoxylated amine compound. By this we mean to include any compound including an amine functional group which has been reacted with at least one alkylene oxide moiety.

In preferred embodiments the alkoxylated amine compounds include more than one alkylene oxide residue.

Suitably alkylene oxide residues include ethylene oxide residues, propylene oxide residues, butylene oxide residues and mixtures thereof.

Preferably the alkoxylated amine compounds include ethylene oxide residues, propylene oxide residues, or mixtures thereof.

Preferably the alkoxylated amine compounds are alkoxylated amines, alkoxylated diamines or alkoxylated polyamines.

Some preferred alkoxylated amine compounds for use herein have the formula $A\text{-}(RO)_n\text{—}H$ wherein A is the residue of an amine and RO is an alkylene oxide residue and n is at least one.

R is preferably an ethylene, propylene or butylene group. R may be an n-propylene or n-butylene group or an isopropylene or isobutylene group. For example R may be $\text{—}CH_2CH_2\text{—}$, $\text{—}CH_2CH(CH_3)\text{—}$, $\text{—}CH_2C(CH_3)_2$, $\text{—}CH(CH_3)CH(CH_3)\text{—}$ or $\text{—}CH_2CH(CH_2CH_3)\text{—}$.

R may comprise a mixture of isomers. For example when R is propylene, the polyhydric alcohol may include moieties $\text{—}CH_2CH(CH_3)\text{—}$ and $\text{—}CH(CH_3)CH_2\text{—}$ in any order within the chain.

Each R may be the same of different. R may comprise a mixture of different groups for example ethylene, propylene or butylene units. Block copolymer units are preferred in such embodiments.

Preferably R is ethylene and/or propylene. More preferably R is $\text{—}CH_2CH_2\text{—}$ or $\text{—}CH(CH_3)CH_2\text{—}$.

In some preferred embodiments the alkoxylated amine compounds (i) comprise a mixture of ethylene oxide residues and propylene oxide residues.

n is at least 1. Preferably n is from 5 to 1000, preferably from 5 to 500, more preferably from 10 to 400, more preferably from 15 to 300, preferably from 20 to 250, suitably from 30 to 200, preferably from 50 to 150.

A is the residue of an amine. Suitably A is the residue of an amino or polyamino compound having at least one NH group. Suitable amino compounds include primary or secondary monoamines having hydrocarbon substituents of 1 to 30 carbon atoms or hydroxyl-substituted hydrocarbon substituents of 1 to about 30 carbon atoms.

Preferably A is the residue of a polyamine.

Polyamines may be selected from any compound including two or more amine groups. Preferably the polyamine is a (poly)alkylene polyamine (by which is meant an alkylene polyamine or a polyalkylene polyamine; including in each case a diamine, within the meaning of "polyamine"). Preferably the polyamine is a (poly)alkylene polyamine in which the alkylene component has 1 to 6, preferably 1 to 4, most preferably 2 to 3 carbon atoms. Most preferably the polyamine is a (poly) ethylene polyamine (that is, an ethylene polyamine or a polyethylene polyamine).

Preferably the polyamine has 2 to 15 nitrogen atoms, preferably 2 to 10 nitrogen atoms, more preferably 2 to 8 nitrogen atoms.

The polyamine may, for example, be selected from ethylenediamine, diethylenetriamine, triethylenetetramine, tetraethylenepentamine, pentaethylene-hexamine, hexaethyleneheptamine, heptaethyleneoctamine, propane-1,2-diamine, 2(2-amino-ethylamino)ethanol, N',N'-bis (2-aminoethyl) ethylenediamine ($N(CH_2CH_2NH_2)_3$), diphenyl 4, 4'-diamine, diamino naphthalene, phenylene diamine, xylene diamine, 1,2-diaminopropane and 1,3-diaminopropane, 1,4-diaminobutane, 1,5-diamino pentane and 1,6-diamino hexane.

Most preferably A is the residue of ethylenediamine.

In some preferred embodiments the alkoxylated amine compounds (x) comprise compounds of formula (II):

(II)

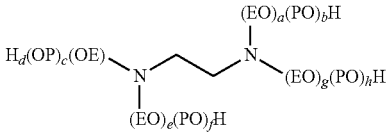

wherein EO represents an ethylene oxide residue, PO represents a propylene oxide residue and at least one of a, b, c, d, e, f, g and h is not 0. The compounds of formula (II) may be prepared by reaction of the ethylene diamine with the ethylene oxide and propylene oxide (when both present) in any combination thereof and in any order, i.e. so as to provide compounds of formula (II) in which the ethylene oxide and propylene oxide residues may be present in any combination and in any order as bonded to the nitrogen of the amine group.

Preferably each of a, b, c, d, e, f, g and h is at least one. Preferably the sum of a, b, c, d, e, f, g and h is from 10 to 500, preferably from 20 to 250, more preferably from 40 to 200.

The skilled person will appreciate that polymeric compounds of formula (II) are usually in the form of mixtures.

Some suitable alkoxylated amine compounds for use herein are described in U.S. Pat. No. 6,838,422.

In some embodiments the composition of the first aspect may comprise (y) aldehyde-alkylphenol copolymers.

Any suitable aldehyde-alkylphenol copolymer may be used and such compounds will be known to those skilled in the art.

Preferably the aldehyde used to prepare the aldehyde-alkylphenol copolymers is selected from formaldehyde or a reactive equivalent thereof, for example paraformaldehyde, C2 to C10 aldehydes and aromatic aldehydes, for example benzaldehyde.

Preferred aldehyde-alkylphenol copolymers are copolymers of formaldehyde and an alkyl phenol. Preferably the phenol is mono-substituted with an alkyl group, preferably at the para position. Preferred alkyl groups have 1 to 40 carbon atoms, preferably 2 to 36 carbon atoms, more preferably 4 to 30 carbon atoms, for example 6 to 24 carbon atoms.

In some embodiments the alkyl phenol is a polyisobutenyl (PIB) substituted phenol.

Polyisobutenyl (PIB) substituted phenols include a hydrocarbyl chain having the repeating unit:

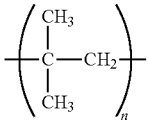

Poly(isobutenes) are prepared by the addition polymerisation of isobutene, $(CH_3)_2C{=}CH_2$. Each molecule of the resulting polymer will include a single alkene moiety.

Conventional polyisobutenes and so-called "highly-reactive" polyisobutenes are suitable for use in preparing additive (y) of the present invention. Highly reactive polyisobutenes in this context are defined as polyisobutenes wherein at least 50%, preferably 70% or more, of the terminal olefinic double bonds are of the vinylidene type as described in EP0565285. Particularly preferred polyisobutenes are those having more than 80 mol % and up to 100% of terminal vinylidene groups such as those described in EP1344785.

Methods of preparing polyalkylene substituted phenols, for example polyisobutene substituted phenols are known to the person skilled in the art, and include the methods described in EP831141.

The hydrocarbyl substituent of the PIB substituent preferably has an average molecular weight of 200 to 3000. Preferably it has a molecular weight of at least 225, suitably at least 250, preferably at least 275, suitably at least 300, for example at least 325 or at least 350. In some embodiments the hydrocarbyl substituent of component (c) has an average molecular weight of at least 375, preferably at least 400, suitably at least 475, for example at least 500.

In some embodiments the phenol may include a PIB substituent having an average molecular weight of up to 2800, preferably up to 2600, for example up to 2500 or up to 2400.

In some embodiments the phenol may include a PIB substituent having an average molecular weight of from 400 to 2500, preferably from 500 to 1500, suitably from 550 to 1300.

In some embodiments the phenol may include a PIB substituent having an average molecular weight of from 200 to 600.

In some embodiments the phenol may include a PIB substituent having an average molecular weight of from 500 to 1000.

In some embodiments the phenol may include a PIB substituent having an average molecular weight of from 700 to 1300.

In some embodiments the phenol may include a PIB substituent having an average molecular weight of from 1000 to 2000.

In some embodiments the phenol may include a PIB substituent having an average molecular weight of from 1700 to 2600, for example 2000 to 2500.

In some preferred embodiment the aldehyde-alkylphenol copolymers (y) have the structures (III) or (IV):

(III)

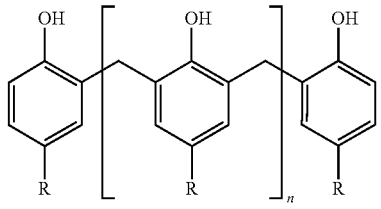

(IV)

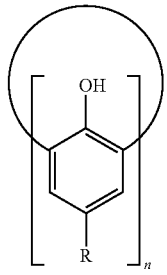

wherein R is hydrogen or an alkyl group and n is at least 1.

Preferably n is from 2 to 12, preferably from 5 to 9; and R is C3-C24-alkyl, preferably C4-C12-alkyl, in particular isononyl, isobutyl or amyl, C6-C12-aryl or -hydroxyaryl or C7-C12-aralkyl.

As the skilled person will appreciate the aldehyde-alkyl phenol copolymers may be prepared from mixtures of monomers, in particular compounds in which R comprises a mixture of alkyl groups. Further suitable aldehyde-alkyl phenol copolymers for use herein include compounds of formula (III) in which the terminal phenol groups are further functionalised, for example by reaction with a fatty acid or an amine and an aldehyde via a Mannich reaction. Compounds of this type are described, for example, in US2007/221539.

Preferably the aldehyde-alkylphenol copolymer has a number average molecular weight of from 500 to 20000, preferably from 1000 to 10000, more preferably from 1500 to 5000, for example from 2000 to 3500.

In some embodiments the composition of the first aspect may comprise (z) acylated nitrogen compounds.

Suitable acylated nitrogen compounds (z) may be made by reacting a carboxylic acid acylating agent with an amine and are known to those skilled in the art. In such compounds the acylating agent is linked to the amino compound through an imido, amido, amidine or acyloxy ammonium linkage.

Preferred acylated nitrogen-containing compounds are hydrocarbyl substituted. The hydrocarbyl substituent may be in either the carboxylic acid acylating agent derived portion of the molecule or in the amine derived portion of the molecule, or both. Preferably, however, it is in the acylating agent portion. A preferred class of acylated nitrogen-containing compounds suitable for use in the present invention are those formed by the reaction of an acylating agent having a hydrocarbyl substituent of at least 8 carbon atoms and a compound comprising at least one primary or secondary amine group.

The acylating agent may be a mono- or polycarboxylic acid (or reactive equivalent thereof) for example a substituted succinic, phthalic or propionic acid or anhydride.

Suitable hydrocarbyl substituted acylating agents and means of preparing them are well known in the art.

Illustrative of hydrocarbyl substituent based groups containing at least eight carbon atoms are n-octyl, n-decyl, n-dodecyl, tetrapropenyl, n-octadecyl, oleyl, chloroctadecyl, triicontanyl, etc. The hydrocarbyl based substituents may be made from homo- or interpolymers (e.g. copolymers, terpolymers) of mono- and di-olefins having 2 to 10 carbon atoms, for example ethylene, propylene, butane-1, isobutene, butadiene, isoprene, 1-hexene, 1-octene, etc. Preferably these olefins are 1-monoolefins.

The term "hydrocarbyl" as used herein denotes a group having a carbon atom directly attached to the remainder of the molecule and having a predominantly aliphatic hydrocarbon character.

The hydrocarbyl-based substituents are preferably predominantly saturated, that is, they contain no more than one carbon-to-carbon unsaturated bond for every ten carbon-to-carbon single bonds present. Most preferably they contain no more than one carbon-to-carbon non-aromatic unsaturated bond for every 50 carbon-to-carbon bonds present.

The hydrocarbyl substituent in such acylating agents preferably comprises at least 10, more preferably at least 12, for example at least 30 or at least 40 carbon atoms. It may comprise up to about 200 carbon atoms. Preferably the hydrocarbyl substituent of the acylating agent has a number average molecular weight (Mn) of between 170 to 2800, for example from 250 to 1500, preferably from 500 to 1500 and more preferably 500 to 1100. An Mn of 700 to 1300 is especially preferred. In a particularly preferred embodiment, the hydrocarbyl substituent has a number average molecular weight of 700-1000, preferably 700-850 for example 750.

The carboxylic acid-derived acylating agent may comprise a mixture of compounds. For example a mixture of compounds having different hydrocarbyl substituents may be used. In some embodiments the acylating agent may have more than one hydrocarbyl substituent. In such embodiments each hydrocarbyl substituent may be the same or different.

Preferred hydrocarbyl-based substituents are polyisobutenes. Such compounds are known to the person skilled in the art.

Preferred hydrocarbyl substituted acylating agents are polyisobutenyl succinic anhydrides. These compounds are commonly referred to as "PIBSAs" and are known to the person skilled in the art.

Conventional polyisobutenes and so-called "highly-reactive" polyisobutenes are suitable for use in the invention. Highly reactive polyisobutenes in this context are defined as polyisobutenes wherein at least 50%, preferably 70% or more, of the terminal olefinic double bonds are of the vinylidene type as described in EP0565285. Particularly preferred polyisobutenes are those having more than 80 mol % and up to 100 mol % of terminal vinylidene groups such as those described in U.S. Pat. No. 7,291,758. Preferred polyisobutenes have preferred molecular weight ranges as described above for hydrocarbyl substituents generally.

Other preferred hydrocarbyl groups include those having an internal olefin for example as described in the applicant's published application WO2007/015080.

An internal olefin as used herein means any olefin containing predominantly a non-alpha double bond, that is a beta or higher olefin. Preferably such materials are substantially completely beta or higher olefins, for example containing less than 10% by weight alpha olefin, more preferably less than 5% by weight or less than 2% by weight. Typical internal olefins include Neodene 151810 available from Shell.

Internal olefins are sometimes known as isomerised olefins and can be prepared from alpha olefins by a process of isomerisation known in the art, or are available from other sources. The fact that they are also known as internal olefins reflects that they do not necessarily have to be prepared by isomerisation.

Preferred carboxylic acid-derived acylating agents are polyisobutenyl substituted succinic anhydrides or PIBSAs. Especially preferred PIBSAs are those having a PIB molecular weight (Mn) of from 300 to 2800, preferably from 450 to 2300, more preferably from 500 to 1300.

The carboxylic acid-derived acylating agent is reacted with an amine. Suitably it is reacted with a primary or secondary amine. Examples of some suitable amines will now be described.

Amine compounds useful for reaction with the acylating agents include polyalkylene polyamines of the general formula:

$$(R^3)_2N[U—N(R^3)]_nR^3$$

wherein each $R^3$ is independently selected from a hydrogen atom, a hydrocarbyl group or a hydroxy-substituted hydrocarbyl group containing up to about 30 carbon atoms, with proviso that at least one $R^3$ is a hydrogen atom, n is a whole number from 1 to 10 and U is a C1-18 alkylene group. Preferably each $R^3$ is independently selected from hydrogen, methyl, ethyl, propyl, isopropyl, butyl and isomers thereof. Most preferably each $R^3$ is ethyl or hydrogen. U is preferably a C1-4 alkylene group, most preferably ethylene.

Other useful amines include heterocyclic-substituted polyamines including hydroxyalkyl-substituted polyamines wherein the polyamines are as described above and the heterocyclic substituent is selected from nitrogen-containing aliphatic and aromatic heterocycles, for example piperazines, imidazolines, pyrimidines, morpholines and derivatives thereof.

Other useful amines for reaction with acylating agents include aromatic polyamines of the general formula:

$$Ar(NR^3_2)_y$$

wherein Ar is an aromatic nucleus of 6 to 20 carbon atoms, each $R^3$ is as defined above and y is from 2 to 8.

Specific examples of polyalkylene polyamines include ethylenediamine, diethylenetriamine, triethylenetetramine, tetraethylenepentamine, tri(tri-methylene)tetramine, pentaethylenehexamine, hexaethylene-heptamine, 1,2-propylenediamine, and mixtures thereof. Other commercially available materials which comprise complex mixtures of polyamines may also be used. For example, higher ethylene polyamines optionally containing all or some of the above in addition to higher boiling fractions containing 8 or more nitrogen atoms etc. Specific examples of hydroxyalkyl-substituted polyamines include N-(2-hydroxyethyl) ethylene diamine, N,N'-bis(2-hydroxyethyl) ethylene diamine, N-(3-hydroxybutyl) tetramethylene diamine, etc. Specific examples of the heterocyclic-substituted polyamines (2) are N-2-aminoethyl piperazine, N-2 and N-3 amino propyl morpholine, N-3(dimethyl amino) propyl piperazine, 2-heptyl-3-(2-aminopropyl) imidazoline, 1,4-bis (2-aminoethyl) piperazine, 1-(2-hydroxy ethyl) piperazine, and 2-heptadecyl-1-(2-hydroxyethyl)-imidazoline, etc. Specific examples of the aromatic polyamines (3) are the various isomeric phenylene diamines, the various isomeric naphthalene diamines, etc.

Preferred amines are polyethylene polyamines including ethylenediamine, diethylenetriamine, triethylenetetramine, tetraethylenepentamine, pentaethylenehexamine, hexaethylene-heptamine, and mixtures and isomers thereof.

In preferred embodiments the reaction product of the carboxylic acid derived acylating agent and an amine includes at least one primary or secondary amine group.

A preferred acylated nitrogen-containing compound for use herein is prepared by reacting a poly(isobutene)-substituted succinic acid-derived acylating agent (e.g., anhydride, acid, ester, etc.) wherein the poly(isobutene) substituent has a number average molecular weight (Mn) of between 170 to 2800 with a mixture of ethylene polyamines having 2 to about 9 amino nitrogen atoms, preferably about 2 to about 8 nitrogen atoms, per ethylene polyamine and about 1 to about 8 ethylene groups. These acylated nitrogen compounds are suitably formed by the reaction of a molar ratio of acylating agent:amino compound of from 10:1 to 1:10, preferably from 5:1 to 1:5, more preferably from 2:1 to 1:2 and most preferably from 2:1 to 1:1. In especially preferred embodiments, the acylated nitrogen compounds are formed by the reaction of acylating agent to amino compound in a molar ratio of from 1.8:1 to 1:1.2, preferably from 1.6:1 to 1:1.2, more preferably from 1.4:1 to 1:1.1 and most preferably from 1.2:1 to 1:1. Acylated amino compounds of this type and their preparation are well known to those skilled in the art and are described in for example EP0565285 and U.S. Pat. No. 5,925,151.

In especially preferred embodiments the acylated nitrogen-containing additive (i) comprises the reaction product of a polyisobutene-substituted succinic acid or succinic anhydride and a polyethylene polyamine to form a succinimide detergent. Preferred polyethylene polyamines include ethylenediamine, diethylenetriamine, triethylenetetramine, tetraethylenepentamine, pentaethylenehexamine, hexaethylene-heptamine and mixtures and isomers thereof. Suitably the polyisobutene substituent of the polyisobutene-substituted succinic acid or succinic anhydride has a number average molecular weight of between 500 and 2000, preferably between 500 and 1500, more preferably between 500 and 1100, suitably between 600 and 1000, preferably between 700 and 800, for example about 750.

Component (z) may comprise a mixture of two or more acylated nitrogen compounds.

In the additive used in the present invention preferably at least 50 wt % of the additive has a number average molecular weight of more than 400, preferably at least 70% of the molecules, more preferably at least 90%, preferably at least 95%, suitably at least 97%.

A suitable method of measuring the molecular weight distribution of the additive is GPC using polystyrene standards.

The skilled person will appreciate that polyisobutene-substituted succinimide detergent additives typically contain a complex mixture of compounds. Such compounds are usually prepared by reacting polyisobutene (PIB) with maleic anhydride (MA) to form a polyisobutene-substituted succinic anhydride (PIBSA), which is then reacted with the polyamine (PAM) to form a polyisobutene-substituted succinimide (PIBSI). In the reaction of the PIB and MA more than one MA can react with each PIB and some unreacted PIB may remain. Each PIBSA molecule can react with one or more PAM molecule as described above. Varying the ratios of the different starting materials and including intermediate purification steps can affect the ratio of the various component of the final additive material.

In some preferred embodiments the fuel compositions of the present invention further comprises a metal deactivating compound.

Any metal deactivating compound known to those skilled in the art may be used and include, for example, the substituted triazole compounds of formula (V) wherein R and R' are independently selected from an optionally substituted alkyl group or hydrogen.

(V)

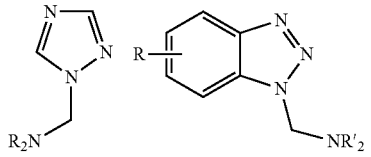

Preferred metal deactivating compounds are those of formula (VI):

(VI)

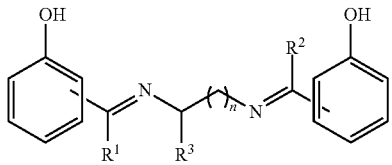

wherein $R^1$, $R^2$ and $R^3$ are independently selected from an optionally-substituted alkyl group or hydrogen, preferably an alkyl group from 1 to 4 carbon atoms or hydrogen. $R^1$ is preferably hydrogen, $R^2$ is preferably hydrogen and $R^3$ is preferably methyl. n is an integer from 0 to 5, most preferably 1.

A particularly preferred metal deactivator is N,N'-disalicyclidene-1,2-diaminopropane, and has the formula shown in formula (VII).

(VII)

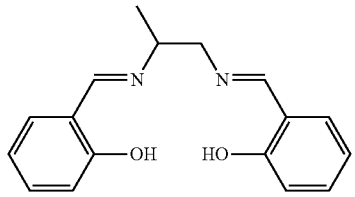

Another preferred metal deactivating compound is shown in formula (VIII):

(VIII)

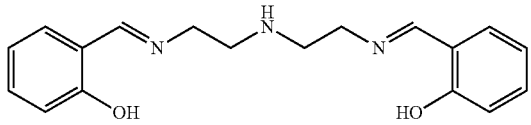

The composition of the first application of the present invention comprises a fuel oil obtained from the distillation of a pyrolysis oil having a boiling point distribution within the gasoline range and one or more additives.

The composition may further comprise one or more fuel oils obtained from hydrocarbon and/or renewable sources.

In embodiments in which the fuel composition comprises a blended fuel comprising a fuel oil obtained from the distillation of a pyrolysis oil and one or more further fuel oils obtained from hydrocarbon and/or renewable sources, such fuels are often blended shortly before distribution. The component fuels are typically stored separately prior to blending and thus the present invention may suitably stabilise the fuel oil obtained from the distillation of a pyrolysis oil during storage.

The antioxidant, when present, is preferably included in the composition of the first aspect in an amount of at least 1 ppm, preferably at least 2 ppm, more preferably at least 5 ppm or at least 10 ppm, as proportion of the pyrolysis oil gasoline distillate. In some embodiments, the antioxidant may be present in an amount of at least 50 ppm, as proportion of the pyrolysis oil gasoline distillate.

The antioxidant, when present, may be included in the composition of the first aspect in an amount of up to 10000 ppm, preferably up to 5000 ppm, more preferably up to 2000 ppm, for example up to 1000 ppm, as proportion of the pyrolysis oil gasoline distillate.

The antioxidant, when present, is preferably included in the composition of the first aspect in an amount of from 1 to 1000, preferably 2 to 500 ppm, as proportion of the pyrolysis oil gasoline distillate.

The stabilising additive, when present, is preferably included in the composition of the first aspect in an amount of at least 1 ppm, preferably at least 2 ppm, more preferably at least 5 ppm, for example at least 10 ppm, as proportion of the pyrolysis oil gasoline distillate. In some embodiments, the stabilising additive may be present in an amount of at least 50 ppm, as proportion of the pyrolysis oil gasoline distillate.

The stabilising additive, when present, may be included in the composition of the first aspect in an amount of up to 10000 ppm, preferably up to 5000 ppm, more preferably up to 1000 ppm, for example up to 700 ppm, as proportion of the pyrolysis oil gasoline distillate.

The stabilising additive, when present, is preferably included in the composition of the first aspect in an amount of from 1 to 1000, preferably 2 to 500 ppm, as proportion of the pyrolysis oil gasoline distillate.

Alkoxylated amine compounds, when present, are preferably included in the composition of the first aspect in an amount of at least 1 ppm, preferably at least 2 ppm, more preferably at least 5 ppm, for example at least 10 ppm, as proportion of the pyrolysis oil gasoline distillate. In some embodiments, the alkoxylated amine compounds may be present in an amount of at least 50 ppm, as proportion of the pyrolysis oil gasoline distillate.

Alkoxylated amine compounds, when present, may be included in the composition of the first aspect in an amount of up to 7000 ppm, preferably up to 3000 ppm, more preferably up to 1000 ppm, for example up to 500 ppm, as proportion of the pyrolysis oil gasoline distillate.

The alkoxylated amine compounds, when present, are preferably included in the composition of the first aspect in an amount of from 1 to 1000, preferably 2 to 500 ppm, as proportion of the pyrolysis oil gasoline distillate.

Aldehyde-alkylphenol copolymers, when present, when present, are preferably included in the composition of the first aspect in an amount of at least 1 ppm, preferably at least 2 ppm, more preferably at least 5 ppm, for example at least 10 ppm, as proportion of the pyrolysis oil gasoline distillate. In some embodiments, the aldehyde-alkylphenol copolymers may be present in an amount of at least 50 ppm, as proportion of the pyrolysis oil gasoline distillate.

Aldehyde-alkylphenol copolymers, when present, may be included in the composition of the first aspect in an amount of up to 5000 ppm, preferably up to 3000 ppm, more preferably up to 1000 ppm, for example up to 700 ppm, as proportion of the pyrolysis oil gasoline distillate.

The aldehyde-alkylphenol copolymers, when present, are preferably included in the composition of the first aspect in an amount of from 1 to 1000, preferably 2 to 500 ppm, as proportion of the pyrolysis oil gasoline distillate.

Acylated nitrogen compounds, when present, are preferably included in the composition of the first aspect in an amount of at least 1 ppm, preferably at least 2 ppm, more preferably at least 5 ppm, for example at least 10 ppm, as proportion of the pyrolysis oil gasoline distillate. In some embodiments, the acylated nitrogen compounds may be present in an amount of at least 50 ppm, as proportion of the pyrolysis oil gasoline distillate.

Acylated nitrogen compounds, when present, may be included in the composition of the first aspect in an amount of up to 5000 ppm, preferably up to 3000 ppm, more preferably up to 1000 ppm, for example up to 700 ppm, as proportion of the pyrolysis oil gasoline distillate.

The acylated nitrogen compounds, when present, are preferably included in the composition of the first aspect in an amount of from 1 to 1000, preferably 2 to 500 ppm, as proportion of the pyrolysis oil gasoline distillate.

Metal deactivating compounds, when present, are preferably included in the composition of the first aspect in an amount of at least 0.1 ppm, preferably at least 0.25 ppm, more preferably at least 0.5 ppm, for example at least 1 ppm, as proportion of the pyrolysis oil gasoline distillate.

Metal deactivating compounds, when present, may be included in the composition of the first aspect in an amount of up to 5000 ppm, preferably up to 3000 ppm, more preferably up to 1000 ppm, for example up to 500 ppm, as proportion of the pyrolysis oil gasoline distillate.

The metal deactivating compounds, when present, are preferably included in the composition of the first aspect in an amount of from 0.1 to 1000, preferably 1 to 100 ppm, as proportion of the pyrolysis oil gasoline distillate.

In this specification any reference to ppm is to parts per million by weight.

In one preferred embodiment the composition of the present invention comprises an antioxidant, an acylated nitrogen compound and a metal deactivating compound.

Preferably the composition of the present invention comprises from 1 to 500 ppm, preferably from 20 to 150 ppm of an antioxidant; from 1 to 500 ppm, preferably from 20 to 150 ppm of an acylated nitrogen compound; and from 1 to 250 ppm, preferably 1 to 100 ppm of a metal deactivating compound, as proportions of the pyrolysis oil gasoline distillate.

Preferably the composition of the present invention comprises from 1 to 500 ppm, preferably from 20 to 150 ppm of a polyisobutenyl succinimide; from 1 to 500 ppm, preferably from 20 to 150 ppm of a phenylene diamine compound; and from 1 to 250 ppm, preferably 1 to 100 ppm of a metal deactivating compound, as proportions of the pyrolysis oil gasoline distillate.

In one especially preferred embodiment the composition of the present invention comprises a polyisobutenyl succinimide; N,N'-di-secondary-butyl-para-phenylenediamine and N,N'-disalicylidene-1,2-propane diamine.

In one especially preferred embodiment the composition of the present invention comprises from 1 to 500 ppm, preferably from 20 to 150 ppm of a polyisobutenyl succinimide; from 10 to 500 ppm, preferably from 20 to 150 ppm of N,N'-di-secondary-butyl-para-phenylenediamine; and from 1 to 250 ppm, preferably 1 to 100 ppm of a N,N'-disalicylidene-1,2-propane diamine, as proportions of the pyrolysis oil gasoline distillate.

The stabilising additive may also comprise a carrier or diluent. Preferred carriers and diluents are aromatic hydrocarbon compounds, especially $C_{10}$ alkyl naphthalene.

In a preferred embodiment, the composition of the first aspect comprises from 1 to 1000 ppm, preferably 2 to 500 ppm of an antioxidant and/or from 1 to 1000 ppm, preferably 2 to 500 ppm of a stabilising additive selected from (x) alkoxylated amine compounds; (y) aldehyde-alkylphenol copolymers; (z) acylated nitrogen compounds and mixtures thereof, as proportions of the pyrolysis oil gasoline distillate.

In a preferred embodiment, the composition of the first aspect comprises from 1 to 1000 ppm, preferably 2 to 500 ppm of an antioxidant and/or from 1 to 1000 ppm, preferably 2 to 500 ppm of alkoxylated amine compounds and/or from 1 to 1000 ppm, preferably 2 to 500 ppm aldehyde-alkylphenol copolymers and/or from 1 to 1000 ppm, preferably 2 to 500 ppm acylated nitrogen compounds, as proportions of the pyrolysis oil gasoline distillate.

The fuel compositions used in the present invention may contain one or more further additives conventionally added to gasoline, for example other detergents, dispersants, antioxidants, anti-icing agents, metal deactivators, lubricity additives, friction modifiers, dehazers, corrosion inhibitors, dyes, markers, octane improvers, anti-valve-seat recession additives, stabilisers, demulsifiers, antifoams, odour masks, conductivity improvers and carrier fluids.

The inclusion of (a) an antioxidant; and/or (b) a stabilising additive selected from (x) alkoxylated amine compounds, (y) aldehyde-alkylphenol copolymers, (z) acylated nitrogen compounds or mixtures thereof has surprisingly been found to improve the storage stability of fuel compositions comprising distillate fuel oils having a boiling point range within the gasoline range obtained from the distillation of pyrolysis oils.

According to a second aspect of the present invention there is provided a method of improving the stability of a fuel composition comprising a fuel oil obtained from the distillation of a pyrolysis oil having a boiling point distribution within the gasoline range, the method comprising adding to the fuel composition one or more additives selected from:

(a) an antioxidant; and (b) a stabilising additive selected from (x) alkoxylated amine compounds; (y) aldehyde-alkylphenol copolymers; (z) acylated nitrogen compounds; and mixtures thereof.

According to a third aspect of the present invention there is provided a use of one or more additives selected from:

(a) an antioxidant; and (b) a stabilising additive selected from (x) alkoxylated amine compounds; (y) aldehyde-alkylphenol copolymers; (z) acylated nitrogen compounds, and mixtures thereof;

to improve the stability of a fuel composition comprising a fuel oil obtained from the distillation of a pyrolysis oil having a boiling point distribution within the gasoline range.

Preferred features of the second and third aspects are as defined in relation to the first aspect. Further preferred features of the invention will now be described.

The one or more additives may be added to the fuel composition at any time.

The method and use of the present invention improve the stability of a composition comprising a fuel oil obtained from the distillation of a pyrolysis oil having a boiling point distribution within the gasoline range.

Preferably the method and use improve the stability of a fuel composition comprising a fuel oil obtained from the distillation of a plastic pyrolysis oil having a boiling point distribution within the gasoline range.

Preferably the method and use improve the storage stability of fuel compositions comprising a fuel oil obtained from the distillation of a pyrolysis oil having a boiling point distribution within the gasoline range.

Preferably the method and use improve the storage stability of fuel composition comprising a fuel oil obtained from the distillation of a plastic pyrolysis oil having a boiling point distribution within the gasoline range.

An improvement in storage stability suitably results in a reduction in degradation of the fuel oil on storage. This may be observed in a number of ways.

In some embodiments the improvement in stability may provide reduced discolouration on storage.

In some embodiments the improvement in stability may provide reduced sedimentation.

In some embodiments the improvement in stability may reduce or prevent increases in viscosity.

In some embodiments the improvement in stability may reduce the formation of gums and particulates in the fuel composition comprising pyrolysis oil gasoline distillate.

In some embodiments the improvement in stability may provide improved filterability, particularly after storage.

In some embodiments the improvement in stability may provide an improvement in low temperature properties of the fuel composition comprising a pyrolysis oil gasoline distillate.

In some embodiments the method and use of the present invention improves the stability of the fuel composition as measured by ASTM D525.

ASTM D525 is a standard test for determining of the stability of gasoline fuels under accelerated oxidation conditions using an induction period method.

In some embodiments the method and use of the present invention improves the stability of the fuel composition as measured by ASTM D873.

ASTM D873 is a standard test for determining of the tendency of fuels to form Qum and deposits under accelerated aging conditions In some embodiments the method and use of the present invention improves the stability of the fuel composition as measured by ASTM D381.

ASTM D381 is a test method for the determination of the existent gum content of aviation fuels, motor gasolines or other volatile distillates. ASTM D381 measures residual material that remains after gasoline is volatilized at an elevated temperature in the presence of air. The evaporated residue is commonly referred to in the industry as "unwashed gums". However, fuel additives, such as those described herein, can be added to gasoline to improve fuel quality. The active components in these fuel additives do not evaporate under D381 test conditions so they contribute to the concentration of unwashed gums. To eliminate their impact on the final concentration of gums determined in the test, the evaporated gums are rinsed with solvent (n-heptane), dried under air and then the remaining residue is reweighed. This residue is referred to as "washed gums" and it reflects only the true concentration of polymeric gums formed in the test fuel and residual solvent insolubles that are present in the fuel.

The test methods ASTM D525, ASTM D873 and ASTM D381 are standard test methods known to the person skilled in the art.

The invention will now be further described with reference to the following non-limiting examples.

Example 1

Two fuel oils having a boiling point distribution within the gasoline range obtained from different plastic pyrolysis oils were tested.

Fuel I had the following properties:

| Element | Concentration |
|---|---|
| P 15 | ND < 10.52 ppm |
| S 16 | 29.92 ppm |
| Cl 17 | 253 ppm |
| K 19 | 0.69 ppm |
| Ca 20 | ND < 0.21 ppm |
| V 23 | ND < 0.05 ppm |
| Cr 24 | ND < 0.03 ppm |
| Mn 25 | 0.22 ppm |
| Fe 26 | 1.32 ppm |
| Co 27 | 0.03 ppm |
| Ni 28 | ND < 0.02 ppm |
| Cu 29 | ND < 0.03 ppm |
| Zn 30 | ND < 0.06 ppm |

Fuel I had an olefin content of 47.2 wt % as measured by ASTM D1319.

Fuel II had the following properties:

| Element | Concentration |
|---|---|
| P 15 | ND < 10.52 ppm |
| S 16 | 29.92 ppm |
| Cl 17 | 253 ppm |
| K 19 | 0.69 ppm |
| Ca 20 | ND < 0.21 ppm |
| V 23 | ND < 0.05 ppm |
| Cr 24 | ND < 0.03 ppm |
| Mn 25 | 0.22 ppm |
| Fe 26 | 1.32 ppm |
| Co 27 | 0.03 ppm |
| Ni 28 | ND < 0.02 ppm |
| Cu 29 | ND < 0.03 ppm |
| Zn 30 | ND < 0.06 ppm |

Fuel II had an olefin content of 55.0 wt % as measured by ASTM D1319.

The following additive compositions were prepared:

Additive Composition A

| Component | Wt % active |
|---|---|
| PIBSI X | 16.8 |
| N,N'-di-secondary-butyl-para-phenylenediamine | 20 |
| N,N'-disalicylidene-1,2-propane diamine | 7.5 |
| Aromatic solvents | balance |

PIBSI X is a polyisobutenyl succinimide obtained from the condensation reaction of a polyisobutenyl succinic anhydride derived from polyisobutene of Mn approximately 750 with a polyethylene polyamine mixture of average composition approximating to tetraethylene pentamine.

Additive Composition B

| Component | Wt % active |
|---|---|
| PIBSI X | 9 |
| N,N'-di-secondary-butyl-para-phenylenediamine | 15 |
| imidazoline | 18 |
| diethylhydroxylamine | 25 |
| Aromatic solvents | balance |

The imidazoline component was provided by the reaction product of a fatty acid and a polyethylene polyamine comprising diethylene triamine (DETA).

Additive Composition C

| Component | Wt % active |
|---|---|
| N, N'-di-secondary-butyl-para-phenylenediamine | 100 |

Additive Composition D

| Component | Wt % active |
|---|---|
| 2,6-ditertbutyl phenol | 25 |
| N, N'-di-secondary-butyl-para-phenylenediamine | 75 |

The 2,6-ditertbutyl phenol used in the above composition contains a minimum of 75 wt % 2,6-di-tertertiary-butyl-phenol and a maximum of 25 wt % tertiary and tritertiary-butyl-phenols.

Example 2

The additive compositions of example 1 were dosed into the fuel oils I and II in the amounts specified in table 1. The stability of the resultant fuel compositions was assessed using the methods of ASTM D525, ASTM D873 and ASTM D381. The results are shown in table 2:

TABLE 1

| Composition | Fuel | Additive | Treat rate (mg/L) |
|---|---|---|---|
| 1 | I | None | — |
| 2 | I | A | 30 |
| 3 | I | C | 30 |
| 4 | II | None | — |
| 5 | II | A | 500 |
| 6 | II | B | 500 |
| 7 | II | D | 100 |

TABLE 2

| Composition | D525 (minutes) | D873 (mg/100 mL) | D381 unwashed (mg/100 mL) | D381 washed (mg/100 mL) |
|---|---|---|---|---|
| 1 (no additive) | 204 | 1425 | 23 | 17 |
| 2 | 601 | 988 | 9 | 1 |
| 3 | 570 | 1037 | 14 | 14 |
| 4 (no additive) | 15 | 2716.5 | 543 | 78.4 |
| 5 | 32 | 2266.8 | — | — |
| 6 | 32 | 2293.5 | 530.4 | 55.2 |
| 7 | 32 | 2287.4 | 445.2 | 45.4 |

These results show that the additive compositions A-D disclosed herein can improve the stability of a gasoline fuel composition derived from a pyrolysis oil (pyrolysis oil gasoline distillate), as measured by the methods of ASTM D525, ASTM D873 and ASTM D381.

Regarding the ASTM D525 test results, each test fuel comprising one of the additive compositions A-D showed an increase in the time taken to degrade the fuel oil under the accelerated oxidation conditions of the test, compared to the base fuel oil comprising no additive. These results demonstrate that the additive compositions disclosed herein can improve the resistance of a pyrolysis oil gasoline distillate to oxidative degradation and therefore improve the stability of said fuel oil.

The ASTM D873 test results show that a lower amount of gum and deposits were formed under accelerated aging conditions in the test fuel comprising one of the additive compositions A-D compared to the base fuel oil comprising no additive. These results demonstrate that the additive compositions disclosed herein can reduce the formation of gum in a pyrolysis oil gasoline distillate and therefore improve the stability of said fuel oil.

Regarding the ASTM D381 test results, each test fuel comprising one of the additive compositions A-D showed a decrease in the amount of gum in the fuel oil, compared to the fuel oil comprising no additive. These results demonstrate that the additive compositions disclosed herein can reduce the formation of gum in a pyrolysis oil gasoline distillate and therefore improve the stability of said fuel oil.

Example 3

Additive composition A of example 1 was further tested for stability enhancing properties in fuel oils III-VI. Fuel oils III-VI have a boiling point distribution within the gasoline range and were obtained from plastic pyrolysis oils. Fuel oils III-VI have the composition/boiling point ranges shown below in table 3:

TABLE 3

| Boiling Point Range | | | | |
|---|---|---|---|---|
| | Fuel oil | | | |
| Temperature, ° F. | III | IV | V | VI |
| IBP, ° F. | 89.3 | 52.8 | 80 | 93.6 |
| 5% Recovered, ° F. | 150.5 | 152.4 | 138.6 | 142.6 |
| 10% Recovered, ° F. | 173.7 | 181.9 | 175.3 | 178.3 |
| 20% Recovered, ° F. | 203 | 221.5 | 214.3 | 215.4 |
| 30% Recovered, ° F. | 228.1 | 258.7 | 245.8 | 247 |
| 40% Recovered, ° F. | 254.2 | 296.9 | 276.3 | 279.5 |
| 50% Recovered, ° F. | 271.3 | 315.6 | 308.4 | 317.1 |
| 60% Recovered, ° F. | 304.6 | 359.4 | 347.2 | 359.3 |
| 70% Recovered, ° F. | 256.1 | 407.6 | 392.4 | 409 |
| 80% Recovered, ° F. | 416.8 | 456.3 | 440.5 | 461.7 |
| 90% Recovered, ° F. | 491.3 | 508.5 | 499.2 | 520 |
| Endpoint, ° C. | 584.4 | 601 | 588.3 | 595.6 |
| Recovery, % (V/V) | 94.7 | 93.4 | 96.3 | 95.2 |
| Residue, % (V/V) | 1.3 | 1.3 | 1.3 | 1.4 |
| Loss, % (V/V) | 4 | 5.3 | 2.4 | 3.4 |
| Aromatics, % (V/V) | 38.46 | 23.85 | 27.07 | 32.06 |
| Olefins, % (V/V) | 47.20 | >55 | >55 | 51.2 |

Additive composition A was dosed into the fuel oils III-VI in the amounts specified in table 4 and tested against the respective base fuel oil having no additive. The stability of the resultant fuel compositions was assessed using the methods of ASTM D525, and ASTM D381. The results are shown in table 4:

TABLE 4

| Fuel oil | Additive comp. | Treat Rate (ppm-vol.) | ASTM D525 (minutes) | ASTM D381 unwashed (mg/100 mL) | ASTM D381 washed (mg/100 mL) |
|---|---|---|---|---|---|
| III | None | — | 70 | 288 | 17.6 |
| | A | 50 | 204 | | |
| | A | 80 | 120 | | |
| | A | 100 | 128 | | |
| | A | 200 | 245 | 188 | 6 |
| IV | None | — | 154 | 580 | 39.8 |
| | A | 100 | 217 | | |
| | A | 200 | 289 | 253 | 7.4 |
| V | None | — | 90 | 322 | 3.8 |
| | A | 200 | 147 | | |
| | A | 300 | 213 | 117 | 1.6 |

TABLE 4-continued

| Fuel oil | Additive comp. | Treat Rate (ppm-vol.) | ASTM D525 (minutes) | ASTM D381 unwashed (mg/100 mL) | ASTM D381 washed (mg/100 mL) |
|---|---|---|---|---|---|
| VI | None | — | 75 | 398 | 62.2 |
| | A | 300 | 99 | | |
| | A | 600 | 129 | 25.2 | 4.2 |

Preferably the fuel oil treated with the additive composition produces a result of 240 mins or greater in the ASTM D525 test and a result of about 5 mg/100 ml or less in the ASTM D381 test, or values close to these levels, in order to demonstrate particularly effective stabilisation of the test fuel oils.

These results show that the additive compositions disclosed herein can improve the stability of a gasoline fuel composition derived from a pyrolysis oil (pyrolysis oil gasoline distillate), as measured by ASTM D525 and ASTM D381.

Regarding the ASTM D525 test results, each test fuel comprising the additive composition A showed an increase in the time taken to degrade the fuel oil under the accelerated oxidation conditions of the test, compared to the fuel oil comprising no additive. These results demonstrate that the additive compositions disclosed herein can improve the resistance of a pyrolysis oil gasoline distillate to oxidative degradation and therefore improve the stability of said fuel oil.

Regarding the ASTM D381 test results, each test fuel comprising the additive composition A showed a decrease in the amount of gum in the fuel oil, compared to the fuel oil comprising no additive. These results demonstrate that the additive compositions disclosed herein can reduce the formation of gum in a pyrolysis oil gasoline distillate and therefore improve the stability of said fuel oil.

The invention claimed is:

1. A fuel composition comprising a fuel oil obtained from the distillation of a pyrolysis oil having a boiling point distribution within the gasoline range and, as additives:

(a) a phenolic antioxidant; and (b) a stabilising additive (z) an acylated nitrogen compound which is the reaction product of a polyisobutene-substituted succinic acid or succinic anhydride and a polyethylene polyamine.

2. A method of improving the stability of a fuel composition comprising a fuel oil obtained from the distillation of a pyrolysis oil, having a boiling point distribution within the gasoline range, the method comprising adding to the composition additives:

(a) a phenolic antioxidant; and (b) a stabilising additive (z) an acylated nitrogen compound which is the reaction product of a polyisobutene-substituted succinic acid or succinic anhydride and a polyethylene polyamine.

3. The fuel composition of claim 1, wherein the pyrolysis oil is a plastic pyrolysis oil.

4. The fuel composition of claim 1, wherein the fuel oil comprises at least 10 wt % olefins.

5. The fuel composition of claim 1 wherein the phenolic antioxidant is selected from tertiary butylhydroquinone (TBHQ or MTBHQ), 2,5-di–tertiarybutylhydroquinone (DTBHQ), pyrogallol, pyrocatechol 2,6-di-tert-butyl-4-methylphenol (BHT), 2,6-ditertiary-butyl-phenol, propylgallate and tertiarybutylcatechol.

6. The fuel composition of claim 1, wherein the fuel composition comprises one or more nitrogen containing antioxidants selected from (i) phenylenediamines;

(ii) substituted hydroxylamines; and (iii) mixtures thereof.

7. The fuel composition of claim 6, wherein the fuel composition comprises phenylene diamine of formula:

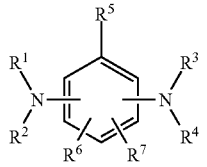

wherein $R^1$, $R^2$, $R^3$, $R^4$, $R^5$, $R^6$ and $R^7$ are independently selected from hydrogen, an optionally substituted alkyl, alkenyl, aryl, alkaryl or aralkyl group, an ester, a carboxylic acid, an aldehyde, a ketone, an ether, an alcohol, an amine or an amide.

8. The fuel composition of claim 6, wherein the fuel composition comprises a compound of formula $R_2NOH$ in which each R is independently hydrogen or an optionally substituted hydrocarbyl group.

9. The fuel composition of claim 1, wherein the stabilising additive further comprises (x) alkoxylated amine compounds.

10. The fuel composition of claim 9, wherein the alkoxylated amine compounds comprise compounds of formula (II):

(II)

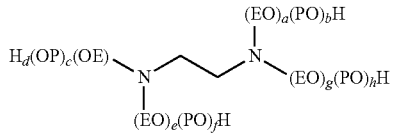

wherein EO represents an ethylene oxide residue, PO represents a propylene oxide residue and at least one of a, b, c, d, e, f, g and h is not 0.

11. The fuel composition of claim 1, wherein the stabilising additive further comprises (y) aldehyde-alkylphenol copolymers.

12. The fuel composition of claim 11, wherein the aldehyde-alkylphenol copolymers have the structures (III) or (IV):

(III)

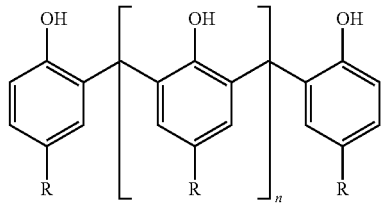

-continued (IV)

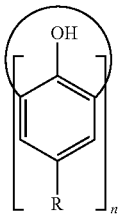

wherein R is hydrogen or an alkyl group and n is at least 1.

13. The fuel composition of claim 1, wherein the fuel composition comprises a metal deactivator.

14. The method of claim 2, wherein the improvement in stability is an improvement in storage stability.

15. The method of claim 2 which provides one or more of:

a reduction in discolouration on storage;

reduced sedimentation;

a reduction in the formation of gums and particulates;

improved filterability; and an improvement in low temperature properties.

* * * * *